United States Patent [19]

Parkins

[11] 4,409,159

[45] Oct. 11, 1983

[54] MOULDING REINFORCED CONCRETE ARTICLES

[75] Inventor: Ian C. N. W. Parkins, Peterborough, England

[73] Assignee: Dow Mac Concrete Limited, Stamford, England

[21] Appl. No.: 276,267

[22] Filed: Jun. 23, 1981

[30] Foreign Application Priority Data

Jun. 26, 1980 [GB] United Kingdom ..... 8020925

[51] Int. Cl.[3] ..... B28B 7/04; B28B 23/06; B28B 7/38

[52] U.S. Cl. ..... 264/39; 264/228; 264/229; 425/111

[58] Field of Search ..... 264/39, 228, 229; 425/62, 111

[56] References Cited

U.S. PATENT DOCUMENTS

| | | | |
|---|---|---|---|
| 3,084,910 | 4/1963 | Allers et al. | 425/111 |
| 4,040,775 | 8/1977 | Nordbak | 264/228 X |
| 4,051,216 | 9/1977 | Bratchell | 264/228 X |

FOREIGN PATENT DOCUMENTS

| | | | |
|---|---|---|---|
| 1262857 | 3/1968 | Fed. Rep. of Germany | 425/111 |
| 2805969 | 8/1978 | Fed. Rep. of Germany | 264/228 |
| 613900 | 5/1978 | U.S.S.R. | 425/111 |
| 730792 | 6/1955 | United Kingdom | 264/228 |
| 1377189 | 12/1974 | United Kingdom | 425/111 |
| 1460149 | 12/1976 | United Kingdom . | |

*Primary Examiner*—Philip E. Anderson

*Attorney, Agent, or Firm*—Leydig, Voit, Osann, Mayer & Holt, Ltd.

[57] ABSTRACT

Equipment for the production of pre-stressed concrete beams or railway sleepers includes two, spaced, reinforcement-tensioning, abutment assemblies with a casting bed lying between the assemblies. Mobile moulds can be moved into and out of the casting bed through one of the abutment assemblies and the latter includes a plurality of displaceable arms carrying reinforcement clamping means. Each arm is displaceable to allow passage of the moulds when the latter are filled with at least partially cured pre-stressed concrete articles. A mould train can be removed as a whole with cured articles therein and individual articles formed by severing the tensioning reinforcing bars or wires and the finished articles subsequently demoulded at a site remote from the casting bed.

12 Claims, 3 Drawing Figures

MOULDING REINFORCED CONCRETE ARTICLES

BACKGROUND OF THE INVENTION

1. Field of the Invention

This invention relates to the manufacture of pre-stressed reinforced concrete articles, for example, beams and railway sleepers.

2. Description of the Prior Art

British Pat. No. 1,460,149 describes the simultaneous manufacture of a plurality of pre-stressed concrete articles containing wires, rods or other elongate reinforcing members and the previously proposed method involves the location between two stressing abutments of a series of gangs of moulds which are introduced to the space between the abutments (known as the casting bed), by positioning the gangs of moulds on lifting tables so that once in position between the abutments, the mould gangs can be raised by the lifting tables so as to receive within their cross-sections appropriate lengths of reinforcing wire or other elongate reinforcing members before the insertion of end plates in the moulds. The end plates are arranged to accommodate the reinforcing members without mutual interference.

As it will be understood, the abutments which support the clamped reinforcing wires during the casting and initial curing process of the concrete are required to resist the application of very considerable forces and the total force will be of the order of hundreds of tons, at least, with the consequent requirement that the abutments should be massive and carried by substantial foundations. While the hereinbefore described method has been found to be satisfactory in practice, the requirement to provide a series of lifting tables depending upon the number of gangs which can be accommodated in the casting bed between the abutments has resulted in complication, the cutting of the wires or strands between moulds while they are in the casting bed and high energy use and further it has been found that in practice it is necessary to position all the series of gangs of moulds between the abutments before initiating any concrete pouring because of the time required for each transfer.

One object of the invention is to provide an apparatus and a method for the manufacture of prestressed reinforced concrete articles which is an improvement on the prior art and in particular have lower energy requirements.

SUMMARY OF THE INVENTION

According to the present invention there is provided in equipment for the production of pre-stressed concrete articles, two spaced reinforcement-tensioning, abutment assemblies, means defining a casting bed lying between the abutment assemblies, and moulds which can be moved into and out of the casting bed through one of the abutment assemblies, one said abutment assembly including at least one displaceable arm carrying reinforcement clamping means, the or each arm being displaceable to allow passage of the moulds when the latter are filled with at least partially cured pre-stressed concrete articles, prior to severing of the reinforcements spanning adjacent moulds.

Further according to the present invention there is provided a method of manufacturing pre-stressed reinforced concrete articles comprising the steps of (a) arranging and tensioning elongate reinforcing members in a casting bed lying between two abutment assemblies each said assembly including clamping means serving to hold the reinforcing members, the clamping means of one said assembly being displaceable to an inoperative position;

(b) moving a plurality of open-ended moulds through said one abutment assembly on to the casting bed with the reinforcing members lying within the cross-section of the moulds;

(c) closing off the ends of the moulds;

(d) filling the moulds with concrete and allowing the concrete to cure to a degree sufficient to accommodate the tension in the reinforcing members;

(e) releasing the reinforcing members from the clamping means;

(f) displacing the clamping means of said one assembly to the inoperative position;

(g) removing the moulds from the casting bed;

(h) severing the reinforcing members at locations between adjacent end-to-end moulds; and (i) de-moulding the pre-stressed concrete articles.

Figure 1:
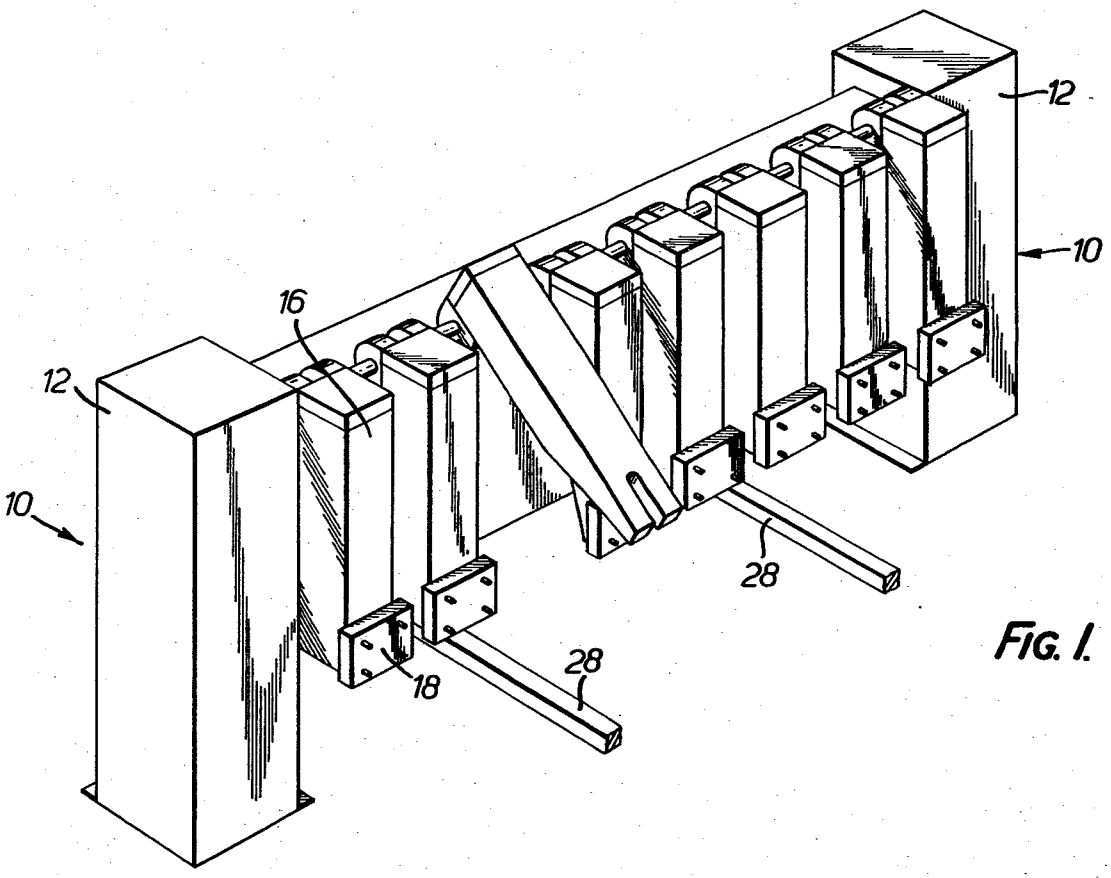
FIG. 1 is a perspective view of an abutment assembly which serves for pre-stressing reinforcing wires or other reinforcing members used in the method in accordance with the invention.

As explained in our prior Specification No. 1,460,149 in detail, pre-stressed concrete articles such as railway sleepers can be manufactured in batches in a plurality of gangs of moulds located on a casting bed between two abutment assemblies which serve to hold the reinforcing wires or other reinforcing members for all the articles to be manufactured and to apply tension to these wires during the casting and initial curing steps. Details of the application of the pre-stressing forces are very well known and will not be described in detail.

One of the abutment assemblies 10 has two uprights 12 of massive size and high strength and a rigid transverse beam 14 extending between the uprights and supporting a plurality of pivotal arms 16, each of which carries a conventional clamp 18 capable of holding and applying tension to the wires which are to extend through a plurality of moulds 20 each forming one mould of one of the gangs 22. The arms 16 are themselves made very rigid and in the position illustrated in FIGS. 1 and 2 (with exception of one arm in FIG. 1) one face of each arm abuts over a large proportion of its area, the face of the beam directed away from the casting bed 24 between the abutments 10. This large abutment area ensures that the unit loading on the face and on the beam is kept as small as possible bearing in mind the high forces involved and it is important that the axis 26 of pivotal movement of each arm shall lie in a position such that when the arms are in abutment with the beam, the faces through which forces are transmitted are precisely parallel. This enables the high torque loads, inevitable when a large number of reinforcing members is being tensioned, to be resisted.

The clamp of each arm is conventional and will not be further described.

The mould gangs 22 are either mounted on a trolley having four wheels movable along rails 28 extending between and beyond the abutments, or alternatively the gangs may include integral axles and support wheels 30, as shown, but again movable on the rails.

Figure 2:
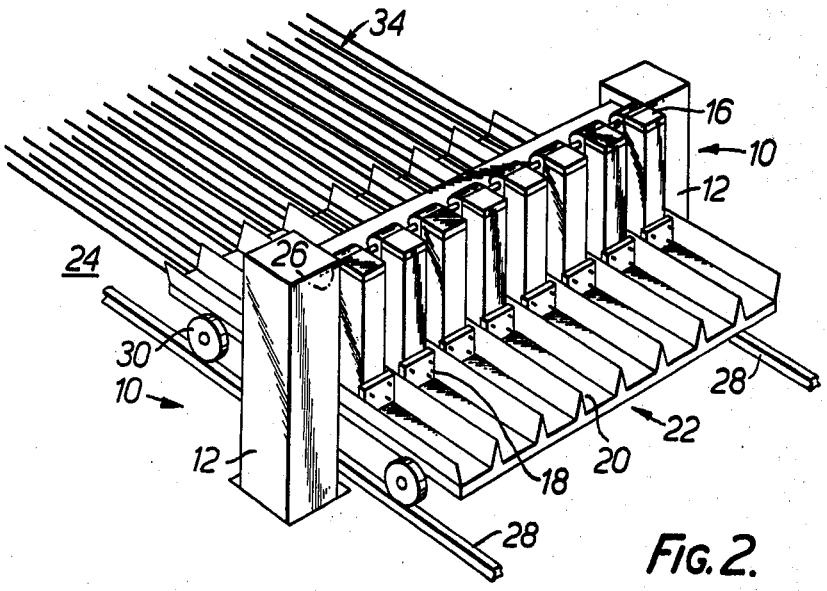
FIG. 2 is a perspective view illustrating the positioning of empty mould gangs.
Figure 3:
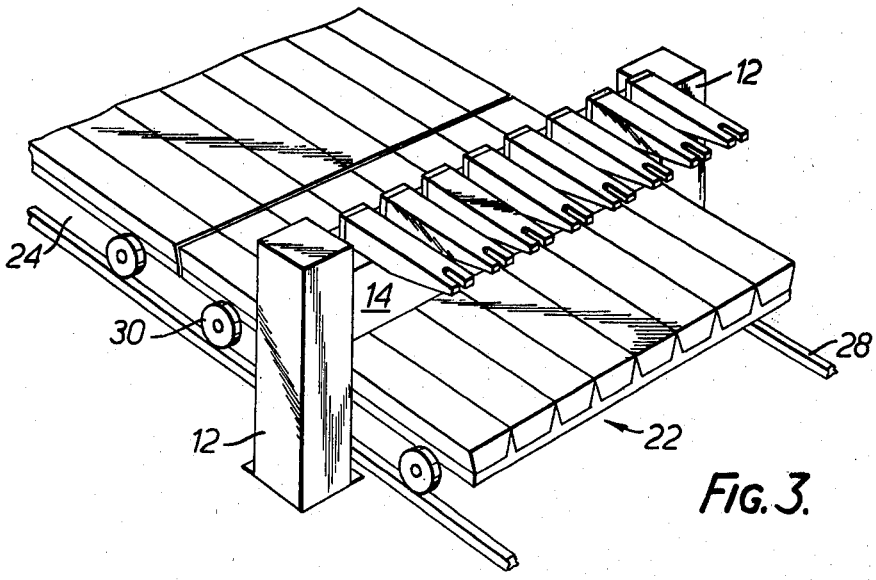
FIG. 3 is a perspective view illustrating the removal of concrete articles after they have been allowed to cure for a sufficient period of time to enable them to withstand the pre-stressing in the concrete effected by the reinforcing wires.

Power means (not shown) will be provided to pivot the arms from the position illustrated in FIGS. 1 and 2 to the position illustrated in FIG. 3.

The casting bed has another, conventional abutment assembly (not shown) and defines the other end of the bed. The conventional abutment is not as wide as the novel abutment because the mould trains do not need to pass through. When more than one casting bed is present, the reduced width of the conventional abutment leaves more space to facilitate access to another bed. This assembly clamps the wires and may be used for applying the pre-stressing forces. The casting bed is plane and horizontal.

The method in accordance with the invention is carried out as follows. Immediately a gang 22 of moulds 20 has been cleaned and made ready for a fresh moulding operation it is moved along the rails 28 until it reaches the end of the casting bed remote from the abutment assembly illustrated and immediately adjacent the unillustrated abutment assembly. At this stage the arms will be in the down position as illustrated in FIGS. 1 and 2 with the pre-stressing wires 34 already in position. The mould gangs may be moved in by power means (not shown) if a whole train of gangs 22 is to be located simultaneously or alternatively mould gangs may be manhandled into position one by one. Stops (not shown) will be provided between the trolleys or between the mobile gang assemblies so that there will automatically be an end plate or other wire spacing between adjacent ends of gangs of articles to enable the insertion of a cutting tool for severing the reinforcing wires after the tension has been removed at the abutments. End plates (not shown) are inserted in each mould and after the tension has been applied to the reinforcing wires, the concrete is poured, the tops of the green moulded articles are smoothed and the concrete is allowed to cure to a state of hardness sufficient to withstand the stresses arising from the tension in the reinforcing wires. The curing process may be accelerated, in known manner, by steam or electricity.

The train of mould gangs 22 is then removed from the casting bed by the power means after raising the arms 16 and a fresh train or series of cleaned and prepared mould gangs can be delivered to the casting bed and the method is then repeated as hereinbefore described. It is not necessary to fill the casting bed with mould gangs before initiating concrete pouring since tension can be applied to the wires prior to location of the mould gangs.

The cured moulded articles which have just been made are removed to a different part of the works where the articles of the individual gangs are separated by cutting through the reinforcing wires or bars, the articles are demoulded and stacked to complete the curing cycle, the mould gangs just used are cleaned and greased ready for the next moulding operation.

It will be apparent from the method hereinbefore described that the equipment required has been simplified by avoiding the need for lifting tables, it becomes possible to obtain better utilisation of the casting space between the abutments since it is no longer necessary to sever the individual articles within the casting bed and in general terms greater flexibility of operation is achieved.

The use of the casting bed only for casting and tensioning purposes assists better utilisation with the result that for a given output fewer costly abutment assemblies will be required. In the ultimate by the use of several casting beds the invention will enable a continuous operation to be maintained, the cycle time being approximately two thirds of that previously required. If electrical curing is employed coupled with the absence of lifting tables of the earlier equipment, there will be a useful energy saving.

The method and equipment hereinbefore described enable all ancillary operations such as de-moulding, mould cleaning and mould pressing to be carried out remotely from the casting bed and thus avoid the risk of contaminating the reinforcing members with resultant poor bonding to the concrete.

I claim:

1. A method of manufacturing pre-stressed reinforced concrete articles comprising the steps of (a) arranging and tensioning elongate reinforcing members in a casting bed lying between two abutment assemblies each said assembly including clamping means serving to hold the reinforcing members, the clamping means of one said assembly being pivotally displaceable to an inoperative position;

(b) moving a plurality of open-ended moulds through said one abutment assembly in the length direction of the reinforcing members on to the casting bed with the reinforcing members lying within the cross-section of the moulds;

(c) closing off the ends of the moulds;

(d) filling the moulds with concrete and allowing the concrete to cure to a degree sufficient to accommodate the tension in the reinforcing members;

(e) releasing the reinforcing members from the clamping means of both assemblies;

(f) pivotally displacing the clamping means of said one assembly to the inoperative position;

(g) removing the moulds in the length direction of the reinforcing members from the casting bed;

(h) severing the reinforcing members at locations between adjacent end-to-end moulds; and (i) de-moulding the pre-stressed concrete articles.

2. A method according to claim 1, wherein filling the moulds on the casting bed is initiated prior to location on the casting bed of all the moulds to be filled.

3. A method according to claim 1 wherein the moulds are cleaned and greased at a location remote from the casting bed.

4. A method according to claim 1, wherein the clamping means of said one abutment assembly are mounted on pivotal arms carried by a transverse beam extending between two uprights of the assembly.

5. In equipment for the production of pre-stressed concrete articles two spaced, reinforcement-tensioning, abutment assemblies, means defining a casting bed lying between the abutment assemblies, and moulds which can be moved into and out of the casting bed through one of the abutment assemblies, one said abutment assembly including at least one pivotally displaceable arm carrying reinforcement clamping means, the or each arm being displaceable by an amount sufficient to allow passage of the moulds in the direction of the length of the reinforcement when the moulds are filled with at least partially cured prestressed concrete articles, prior to severing of the reinforcements spanning adjacent moulds.

6. Equipment according to claim 5, wherein the moulds are arranged as a series of gangs, each gang comprising a plurality of side-by-side moulds, and each mould of each gang being arranged to pass beneath a corresponding said displaceable arm.

7. Equipment according to claim 5, comprising wheels supporting the moulds.

8. Equipment according to claim 5, comprising wheeled trolleys supporting the moulds.

9. Equipment according to claim 7, comprising rails serving to carry the wheel-supported moulds.

10. Equipment according to claim 5 comprising detachable end plates for each mould so that the moulds are delivered to the casting bed ready for casting with end plates removed, the detachable end plates being replaced for use when the moulds are in situ ready for casting.

11. Equipment according to claim 5, comprising cutter means remote from the casting bed for severing reinforcement when partially cured articles are removed from the casting bed prior to de-moulding.

12. Equipment according to claim 5, wherein said one abutment assembly includes two uprights and a transverse beam carrying the related arm, a face of the beam directed away from the other said abutment assembly serving as a torque-resisting surface to a complementary surface of the or each arm when in the operative position(s) with reinforcement material clamped and tensioned in the clamping means.

* * * * *